US009346643B2

(12) United States Patent
Ito

(10) Patent No.: US 9,346,643 B2
(45) Date of Patent: May 24, 2016

(54) TRANSPORTATION DEVICE AND RECORDING APPARATUS

(75) Inventor: Shun Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 758 days.

(21) Appl. No.: 13/184,331

(22) Filed: Jul. 15, 2011

(65) Prior Publication Data

US 2012/0037680 A1 Feb. 16, 2012

(30) Foreign Application Priority Data

Aug. 10, 2010 (JP) ..... 2010-179551

(51) Int. Cl.
*B65H 23/34* (2006.01)
*B41J 11/00* (2006.01)

(52) U.S. Cl.
CPC ..... *B65H 23/34* (2013.01); *B41J 11/0005* (2013.01); *B65H 2301/51256* (2013.01); *B65H 2801/12* (2013.01)

(58) Field of Classification Search
CPC ..... B65H 23/34; B65H 29/70; B65H 2301/51256; B41J 11/0005; G03G 15/6576
USPC ..... 242/348, 615, 615.2, 615.3, 564, 564.3, 242/564.4, 566, 598.6; 400/613; 399/406; 271/188, 209; 374/104
See application file for complete search history.

(56) References Cited

U.S. PATENT DOCUMENTS 5,324,124 A * 6/1994 Bayerle et al. ..... 400/636
6,139,140 A * 10/2000 Rasmussen et al. ..... 347/104
6,259,888 B1 * 7/2001 Kazama et al. ..... 399/406
6,371,479 B1 * 4/2002 Osaka et al. ..... 271/186
7,036,923 B2 * 5/2006 Takagi et al. ..... 347/104
7,222,955 B2 * 5/2007 Ohashi et al. ..... 347/104
2009/0190983 A1 7/2009 Yamamoto et al.
2009/0190985 A1 7/2009 Yamamoto et al.

FOREIGN PATENT DOCUMENTS

| | | |
|---|---|---|
| JP | 2-8126 | 1/1990 |
| JP | 11-92010 | 4/1999 |
| JP | 2007-238322 | 9/2007 |
| JP | 2009-91115 | 4/2009 |
| JP | 2009-179416 | 8/2009 |
| JP | 2009-179417 | 8/2009 |

* cited by examiner

*Primary Examiner* — Sang Kim
*Assistant Examiner* — Nathaniel Adams
(74) *Attorney, Agent, or Firm* — Workman Nydegger

(57) ABSTRACT

A transportation device includes a first roller that transports a sheet-shaped medium from an upstream to downstream in a transporting direction; a guide member that has a guide section extended along the transporting direction and is arranged upstream of the first roller in the transporting direction; and a second roller that is movable between a correcting position where the second roller pinches the sheet-shaped medium with the first roller and corrects a curl of the sheet-shaped medium, and a standby position where the second roller separates from the transporting passage further than the correcting position, wherein the guide member is movable to an escaping position that is separated from a moving passage that is from the correcting position to the standby position of the second roller if the second roller moves to the correcting position.

8 Claims, 8 Drawing Sheets

TRANSPORTATION DEVICE AND RECORDING APPARATUS

The entire disclosure of Japanese Patent Application No: 2010-179551, filed Aug. 10, 2010 is expressly incorporated by reference herein in its entirety.

BACKGROUND

1. Technical Field

The present invention relates to a transportation device having a function that corrects a curl of a sheet-shaped medium for example, roll paper, and a recording apparatus including the transportation device.

2. Related Art

In the related art, a printer that is a type of this recording apparatus includes a print head (a recording unit) that performs a recording process with respect to the roll paper (the sheet-shaped medium) and an decurling mechanism (a curl correcting mechanism) that corrects the curl (a tendency to be wound) of the roll paper (for example, JP-A-2009-179416).

The decurling mechanism described in JP-A-2009-179416 includes a transporting roller that transports the roll paper, a decurling roller that pinches the roll paper between the transporting rollers and a free roller (a driven roller) that is arranged upstream of the transporting roller in the transporting direction of the roll paper, and rotates in connection with a movement of the roll paper that is transported. Thus, the roll paper is bent between a position where the roll paper is pinched and a position where the roll paper is engaged with the free roller in a state where the roll paper is pinched between the transporting roller and the decurling roller so that the curl is capable of being corrected.

However, in JP-A-2009-179416, a pair of transporting rollers is provided upstream of the free roller in the transporting direction. Thus, when the roll paper is transported to a circumferential surface of the free roller by the pair of transporting rollers, the free roller rotates in connection with the movement of the roll paper so that the roll paper is guided toward the transporting roller. However, when the roll paper is transported to separate from the pair of transporting rollers toward downstream thereof, if the leading edge side of the roll paper is curled so as to separate from the transporting passage, the curled leading edge portion may be drawn to the free roller. Thus, if the leading edge portion of the roll paper is drawn to the free roller, there is a problem that a failure of transportation of the roll paper may occur.

SUMMARY

The invention has been made to solve the foregoing problem and an advantage of some aspects of the invention is that a transportation device and a recording apparatus including the transportation device are provided, which are capable of suppressing the generation of the failure of the transportation that is caused by the curl of the sheet-shaped medium when the sheet-shaped medium is transported to perform a curl correcting process.

According to an aspect of the invention, there is provided a transportation device which includes a first roller that transports a sheet-shaped medium from an upstream to downstream in a transporting direction along a transporting passage; a guide member that has a guide section extended along the transporting direction and is arranged at upstream of the first roller in the transporting direction; and a second roller that is movable between a correcting position where the second roller pinches the sheet-shaped medium with the first roller and corrects a curl of the sheet-shaped medium, and a standby position where the second roller separates from the transporting passage further than the correcting position, wherein the guide member is movable to an escaping position where the guide member separates from a moving passage that is from the correcting position to the standby position of the second roller if the second roller moves to the correcting position.

According to the configuration, even though the leading edge is curled, the sheet-shaped medium is guided by the guide member having the guide section that is extended in the transporting direction so as to move along the transporting passage. Accordingly, the curled leading edge portion does not separate from the transporting passage but transported to the first roller. Thus, the guide member is movable to the escaping position where the guide member separates from the moving passage toward the standby position from the correcting position of the second roller, in a case where the second roller is moved to the correcting position. Thus, even though the second roller moves, the interference with the second roller is capable of being avoided. Accordingly, before the curl is corrected, when the sheet-shaped medium is transported, the sheet-shaped medium is capable of suppressing the generation of the failure of the transportation.

In the transportation device of the invention, the guide member may move toward a guide position where the guide member guides the sheet-shaped medium from the escaping position to the first roller along the transporting passage according to the movement of the second roller from the correcting position to the standby position.

According to the configuration, when the second roller moves from the correcting position to the standby position, the guide member moves from the escaping position to the guide position and the sheet-shaped medium is capable of being reliably guided to the first roller at the guide position.

The transportation device may further include a transporting roller that transports the sheet-shaped medium from upstream in the transporting direction toward the first roller, wherein the guide member may be longer than the diameter of the transporting roller in the transporting direction and the downstream end thereof may be arranged at downstream of a upstream end of the circumferential surface of the first rollers in the transporting direction.

According to the configuration, the sheet-shaped medium is capable of being reliably transported toward the first roller by the transporting roller. Also, the length of the guide member is longer than the diameter of the transporting roller in the transporting direction so that it is possible to suppress the curled leading edge portion of the sheet-shaped medium from being drawn or wound in the transporting roller. Thus, the downstream end of the guide member in the transporting direction is arranged at downstream of the upstream end of the circumferential surface of the first roller. Accordingly, even in a case where the leading edge portion of the sheet-shaped medium is curled, the sheet-shaped medium is capable of being reliably guided to the circumferential surface of the first roller.

In the transportation device, a plurality of the transporting roller may be arranged with gaps in the width direction of the sheet-shaped medium that crosses the transporting direction, and the guide section of the guide member may be arranged between each of the plurality of transporting rollers that are positioned adjacent to each other in the width direction.

According to the configuration, the guide section of the guide member is arranged between each of the adjacent transporting rollers in the width direction and the guide section is arranged at the position corresponding to the end section of the sheet-shaped medium in the width direction so that the end section of the sheet-shaped medium is capable of being reliably guided.

The transportation device may further include a transporting passage forming member that is arranged at upstream of the guide section of the guide member in the transporting direction, wherein the guide member may have a base end section that is arranged at upstream in the transporting direction and the comb-shape guide section that extends toward downstream in the transporting direction from the base end section, and the guide member may displace between a guide position where the guide member oscillates about the base end section as the center so that the guide section forms the transporting passage and the escaping position where the guide section separates from the transporting passage, and wherein a notch that may permit a displacement of the guide section is formed at a position corresponding to the guide section in the width direction of the sheet-shaped medium that crosses the transporting direction at a downstream of the transporting passage forming member in the transporting direction.

According to the configuration, the guide member oscillates about the base end as the center that is provided at the upstream in the transporting direction so that the transportation of the sheet-shaped medium is not disturbed and the guide section is capable of being displaced. Thus, the guide section forms the comb-shape transporting passage at the guide position so that the sliding and contacting load with the sheet-shaped medium is capable of being suppressed and the sheet-shaped medium is capable of being guided. Also, the notch is provided at the transporting passage forming member so that the gap between the transporting passage forming member and the guide section becomes small and the sheet-shaped medium is capable of suppressing the drawing in the gap.

In the transportation device, a bending member may be formed at the guide section of the guide member and the bending member is bent so as to separate from the transporting passage forming member as the guide section faces upstream in the transporting direction.

According to the configuration, the bending section is formed at the guide section of the guide member so that the leading edge portion thereof is capable of being guided to the front end of the guide section at the bending section even in a case where the leading edge portion of the sheet-shaped medium is curled when the sheet-shaped medium is transported from the upstream.

The transportation device may further include a cam mechanism that has a camshaft, a first cam member and a second cam member which rotate according to the rotation of the camshaft, wherein the guide member may move according to the rotation of the first cam member and the second roller moves according to the rotation of the second cam member.

According to the configuration, the first cam member moves in connection with the movement of the second cam member so that the guide member is capable of being moved to the escaping position at the timing in which the second roller moves from the standby position to correcting position.

According to another aspect of the invention, there is provided a recording apparatus which includes a retaining section that retains a sheet-shaped medium in a state of a roll body that winds and overlaps the sheet-shaped medium in a roll shape; a recording unit that performs the recording with respect to the sheet-shaped medium that is unwound from the roll body; and the transportation device.

According to the configuration, the same effect as that of the transportation device is capable of being obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment, of which an ink jet type printer (sometimes referred to as "printer" below) that is a type of the recording apparatus of the invention is specified, will be described.

Figure 1:
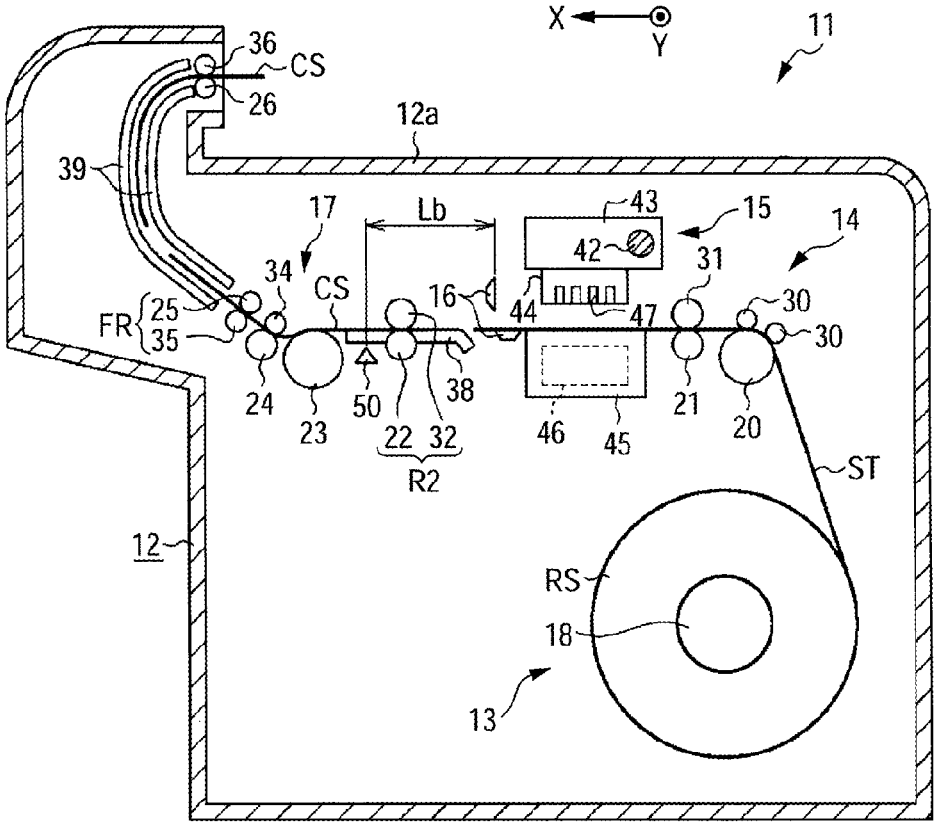
FIG. 1 is a cross-sectional view illustrating an outline configuration of a printer that includes a transportation device of an embodiment.
Figure 7:
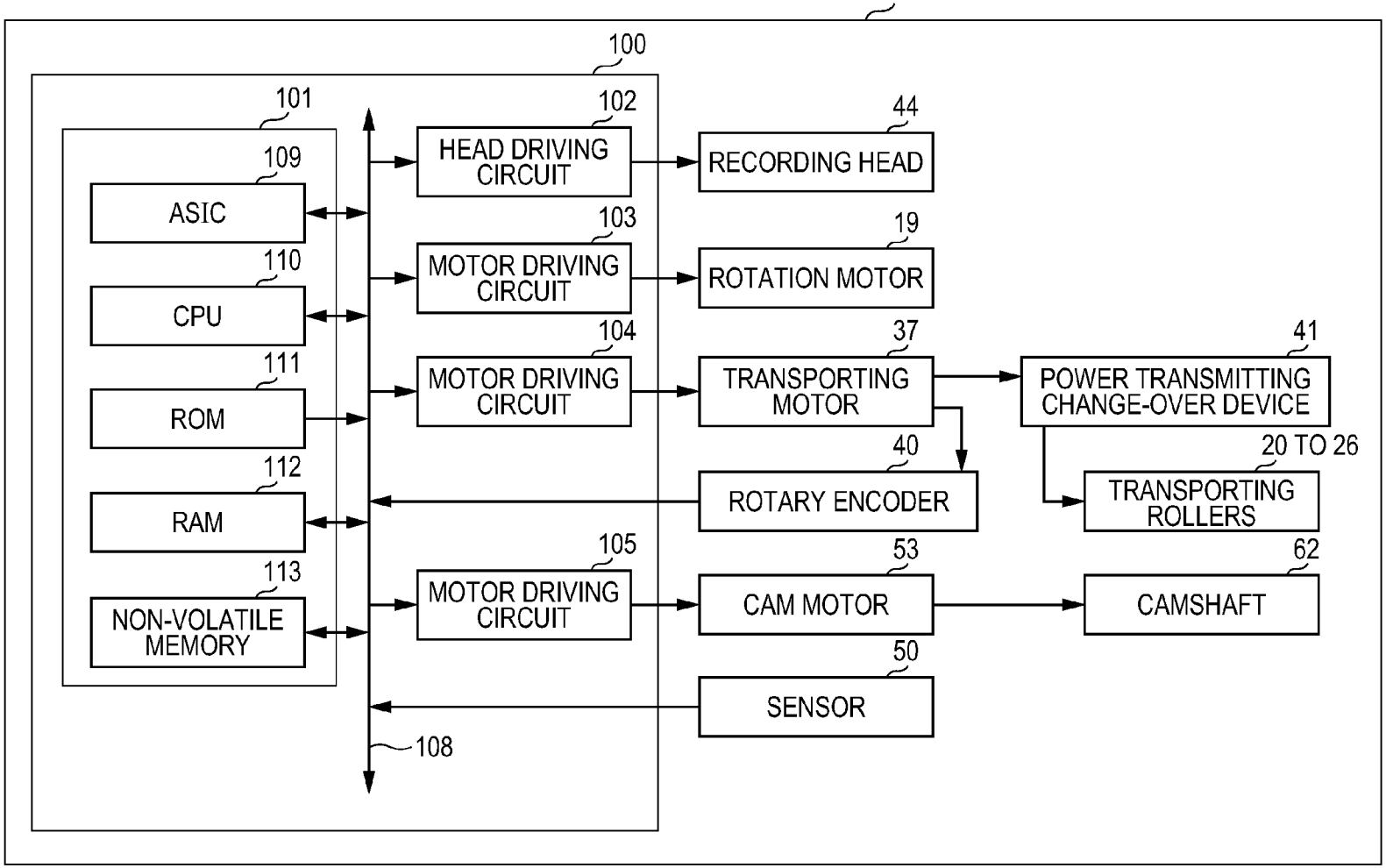
FIG. 7 is a block diagram illustrating an electrical configuration of the printer of the embodiment.

As shown in FIG. 1, a printer 11 includes a main case 12 having a paper discharging section 12*a*, a retaining section 13 that retains a sheet ST as a sheet-shaped medium in a state of a roll body RS that is wound and overlapped in a roll shape and a control device 100 (see FIG. 7).

Also, the printer 11 includes a transportation device 14 that transports the sheet ST along a transporting passage that is extended toward the paper discharging section 12*a* from the retaining section 13 within the main case 12. A recording section 15 that performs the recording with respect to the sheet ST that is unwound from the roll body RS and a cutter 16 are provided within the main case 12. Also, a curl correcting mechanism 17 that constitutes a portion of the transportation device 14 is provided downstream of the cutter 16 in the transporting direction X.

The sheet ST that is transported by the transportation device 14 is printed (recorded) on the surface at the recording section 15 while the cutter 16 cuts a portion where the printing is completed on the surface. After the leading end portion of the cut sheet ST becomes a cut sheet CS (cut recording medium), the curl is corrected at the curl correcting mechanism 17. Also, in the description below, in a case of writing as "the sheet ST", it includes a lengthy sheet that is unrolled from the roll body RS and a sheet that becomes the cut sheet CS that is cut from the lengthy sheet.

Next, the retaining section 13 will be described.

The retaining section 13 includes a rotation shaft 18 that rotatably supports the roll body RS and a rotation motor 19 (see FIG. 7) that rotates the rotation shaft 18. Thus, when the rotation shaft 18 rotates counterclockwise in FIG. 1 according to the driving of the rotation motor 19, the sheet ST is unrolled from the roll body RS.

Next, the transportation device 14 will be described.

The transportation device 14 includes a plurality of transporting rollers 20 to 26 which transports the sheet ST to the downstream from the upstream in the transporting direction X, and driven rollers 30, 31, 32, 34, 35 and 36 which pinch the sheet ST between each of the transporting rollers 20, 21, 22, 24, 25 and 26. Each of the transporting rollers 20, 21, 22, 24, 25 and 26, and each of the driven rollers 30, 31, 32, 34, 35 and 36 interpose the transporting passage and are arranged in positions facing each other. Also, in the below description, the transporting roller 22 and the driven roller 32 that are paired with each other are referred to as a transporting roller pair R2.

Also, the transportation device 14 includes a transporting motor 37 (see FIG. 7) that rotates the transporting rollers 20 to 26, a transporting passage forming member 38 that is arranged at a position corresponding to the transporting roller pair R2, and a reversing passage forming member 39 that forms a reversing passage between the transporting roller 25 and the transporting roller 26. As shown in FIG. 7, a rotary encoder 40 that detects a rotation speed, a rotation position and a rotation direction of the output shaft, and a power transmitting changeover device 41 are provided at the output shaft of the transporting motor 37. The power transmitting changeover device 41 switches the transferring destination of the power between the transporting motor 37 and the transporting rollers 20 to 26 according to a transporting step of the sheet ST. Also, the transporting roller 25 and the driven roller 35 that become the pair, transport the sheet ST that passes the curl correcting mechanism 17 to the reversing passage so that the pair is referred to as a feed roller FR.

Next, the recording section 15 will be described.

The recording section 15 includes a guide shaft 42 that is arranged at the upper side of the transporting passage, a carriage 43 that is supported by the guide shaft 42 and a recording head 44 that is supported by the carriage 43 as a recording unit. Also, the recording section 15 includes a supporting member 45 that is arranged at a position where the supporting member faces the recording head 44 that pinches the transporting passage.

The guide shaft 42 is installed in the main case 12 so as to extend along a width direction Y of the sheet ST, which crosses (orthogonally) the transporting direction X. Also, the carriage 43 is guided by the guide shaft 42 and reciprocates along the width direction Y.

A plurality of suction holes (not shown) is formed at the upper surface of the supporting member 45 and a suction mechanism 46 that absorbs the sheet ST through the suction holes at the supporting member 45 is provided within the supporting member 45. A plurality of nozzles 47 that ejects ink as a liquid is provided at the recording head 44. Thus, ink is ejected from the nozzles 47 of the recording head 44 to the surface (the upper surface in FIG. 1) of the sheet ST that is supported on the supporting member 45 so that the recording (printing) of the sheet ST is performed.

Also, in the printer 11, printing data that are included in one printing job is plurally divided and the printing process is performed every scanning of the carriage 43 based on each of the divided printing data. The portion where the printing of the sheet ST is performed is transported intermittently during the printing processes. In other words, the forming of the band shape image in which the width direction Y becomes the longitudinal direction and the transportation of the paper are repeated alternatively at the recording section 15 so that the image is formed based on one printing job.

Also, the cutting of the sheet ST by the cutter 16 is performed in a state where the transportation of the sheet ST by the transportation device 14 is stopped and the upstream thereof is retained with the suction mechanism 46 of the supporting member 45 while the downstream thereof is pinched with the transporting roller pair R2. In the embodiment, when the transportation of the sheet ST is not stopped so as to perform the printing, the cutting of the sheet ST is performed. Thus, the cut sheet CS that is cut is stopped by the transporting rollers 22 to 26 and is transported continuously. The cut sheet CS is discharged to the paper discharging section 12*a* after the cut sheet CS is reversed at the reversing passage.

Next, the curl correcting mechanism 17 that constitutes a portion of the transportation device 14 will be described.

Some of the configurational elements of the curl correcting mechanism 17 are the transporting roller 23, the transporting roller 24 as the first roller and the driven roller 34 as the second roller. Also, the curl correcting mechanism 17 includes a sensor 50, guide members 51 and 52 (see FIG. 2), a cam motor 53 (see FIG. 7) and a cam mechanism 60 (see FIG. 2).

The sensor 50 is a reflective type optical sensor that is electrically connected to the control device 100. The sensor 50 has a light source and a light receiving section (not shown), and is arranged at a position that becomes the lower side of the transporting passage forming member 38. The sensor 50 is formed such that the light receiving section receives the reflected light that is projected toward the upper side from the light source, and an electrical signal is output to the control device 100 according to the strength of the reflected light. For example, the sensor 50 outputs an ON value that is larger than a predetermined threshold value when the sheet ST is an object of the reflection, and outputs an OFF value that is less than or equal to the threshold value when the sheet ST is not an object of the reflection. Accordingly, the output value of the sensor 50 varies from the OFF value to the ON value so that the leading edge of the sheet ST is detected in the transporting direction X.

Figure 2:
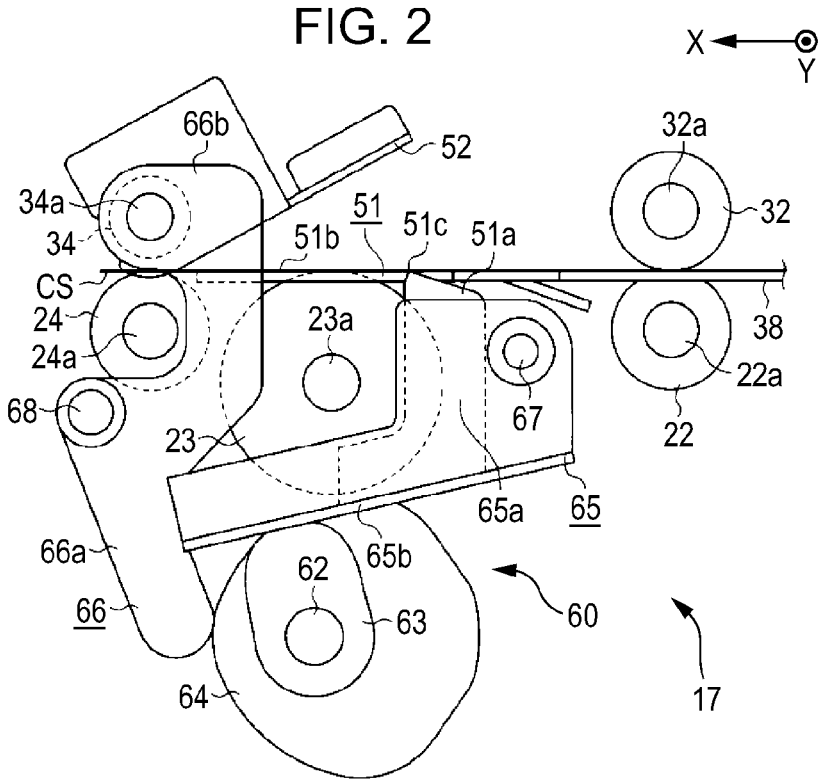
FIG. 2 is a side view illustrating a curl correcting mechanism when a curl correction operation is not performed.
Figure 3:
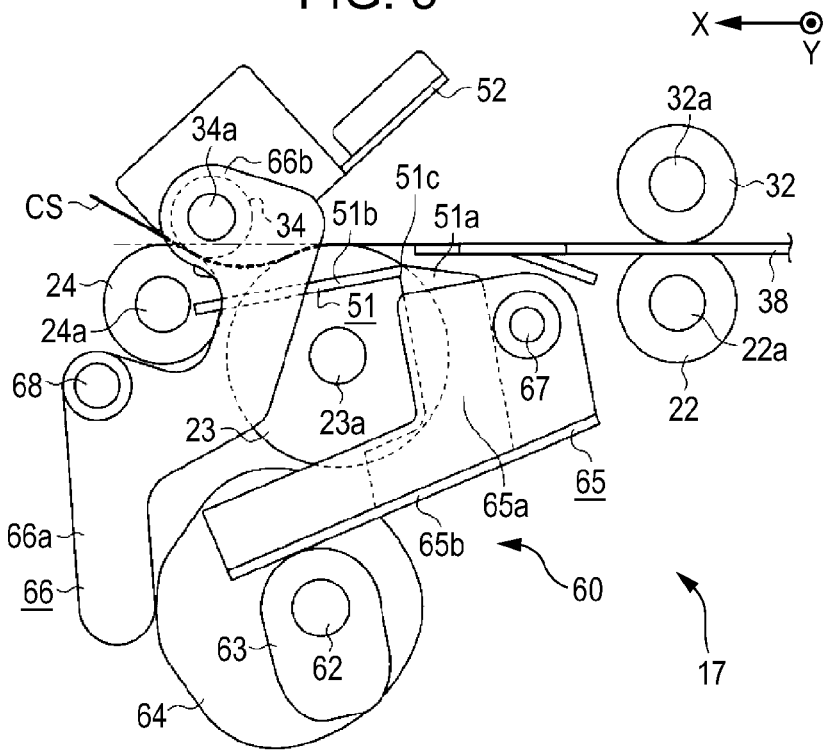
FIG. 3 is a side view illustrating a curl correcting mechanism when the curl correction operation is performed.

As shown in FIGS. 2 and 3, the transporting rollers 22, 23 and 24 are supported by the shaft sections 22*a*, 23*a* and 24*a* that are extended in the width direction Y respectively. Also, the driven rollers 32 and 34 are supported at the shaft sections 32*a* and 34*a* that are extended in the width direction Y respectively.

Figure 4:
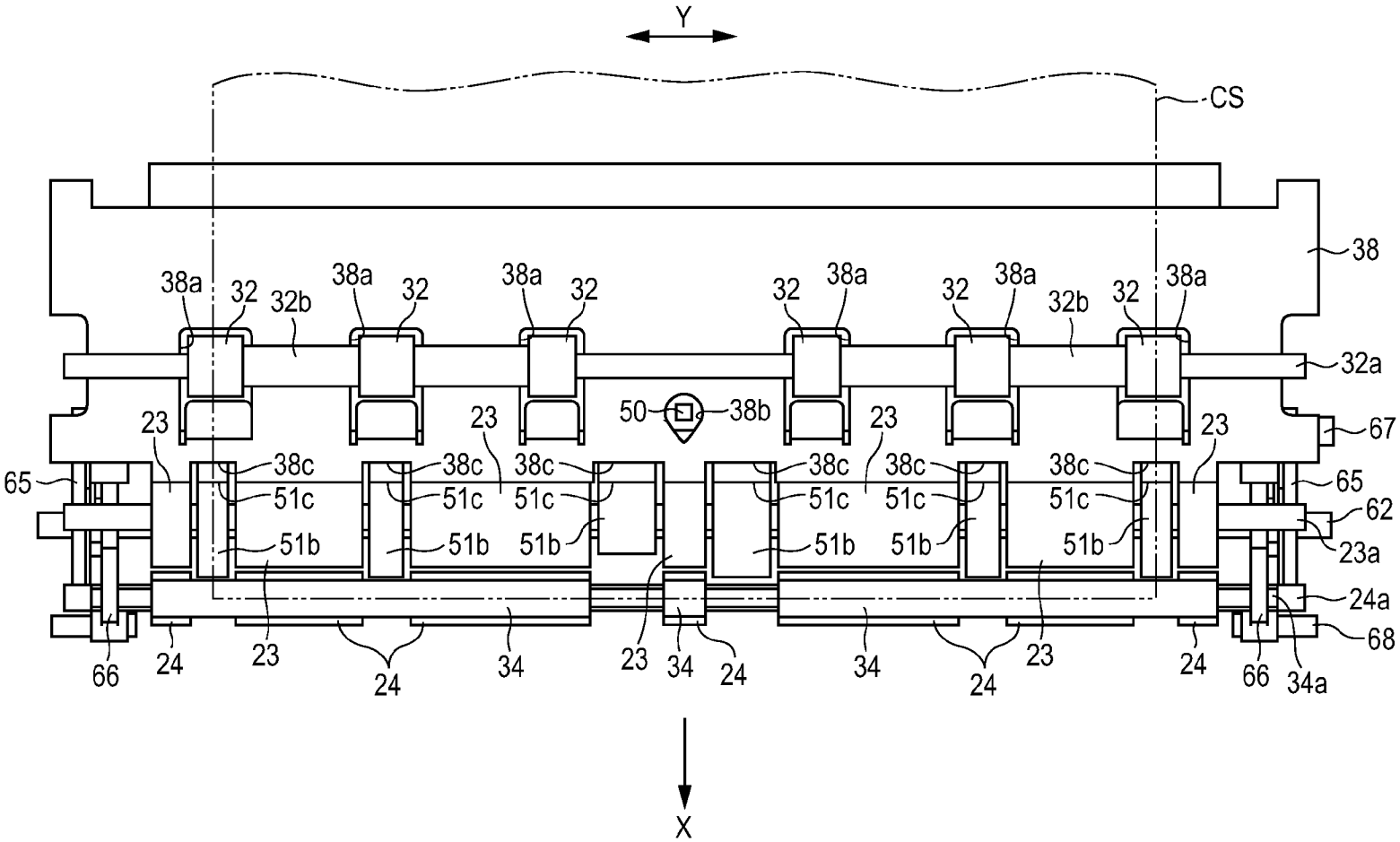
FIG. 4 is a top plan view illustrating the curl correcting mechanism when the curl correction operation is not performed.
Figure 5:
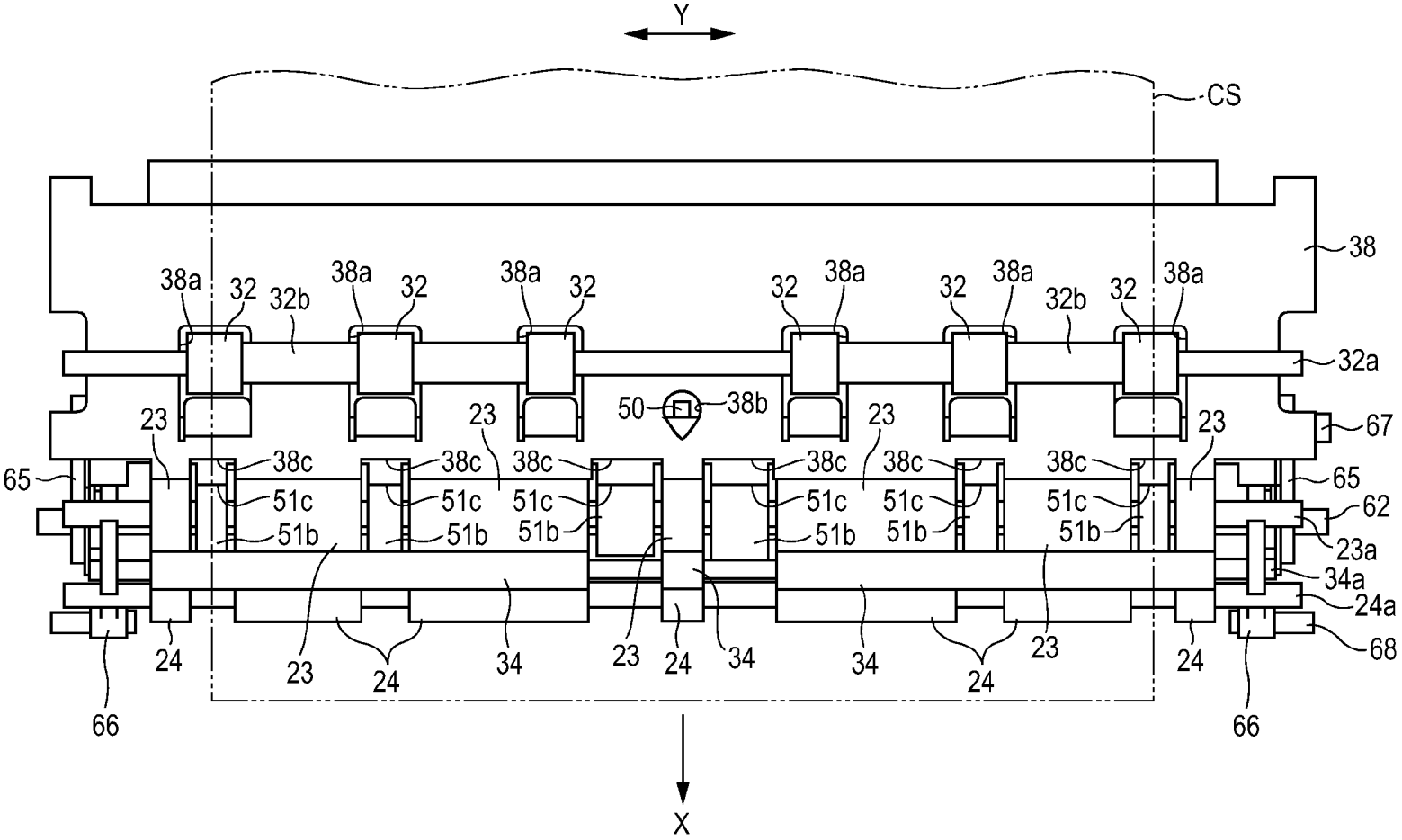
FIG. 5 is a top plan view illustrating the curl correcting mechanism when the curl correction operation is performed.

As shown in FIGS. 4 and 5, a plurality of the driven rollers 32 are provided along the width direction Y (in the embodiment, six). In the same drawings, three driven rollers 32 at the right side and three driven rollers 32 at the left side are connected by connecting sections 32*b* respectively. The transporting roller 22 is also provided along the width direction Y the same number as that of the driven roller 32 (in the embodiment, six) even though not shown. Also, a plurality of the transporting rollers 23 and 24 provide gaps along the width direction Y to each other (in the embodiment, seven). Also, one driven roller 34 that has a small width is provided near the center of the width direction Y and one driven roller 34 that has a large width is provided at both sides thereof respectively (three in total).

At the transporting passage forming member 38, insert holes 38*a* are formed at positions corresponding to the driven roller 32 and the transporting roller 22 respectively. Thus, the transporting roller 22 and the driven roller 32 contact each other through the insert hole 38*a*. Also, at the transporting passage forming member 38, an insert hole 38*b* that passes a light of the sensor 50 is formed at a position corresponding to the insert hole 38*a* in the transporting direction X, that is at a position that becomes near the center in the width direction Y.

As shown in FIG. 3, when the sheet ST is pinched between the transporting roller 24 and the driven roller 34, the driven roller 34 is rotated according to the transportation of the sheet ST and bends the sheet ST between the driven roller 34 and the transporting roller 23. Accordingly, the curl (the tendency to be wound) of the sheet ST is corrected (uncurl). Also, the transporting roller 23 is arranged upstream of the transporting roller 24 in the transporting direction X and transports the sheet ST toward the transporting roller 24. When the sheet ST is bent, the transporting roller 23 functions as a supporting section that supports the upstream of the bending portion.

As shown in FIGS. 2 and 3, the guide members 51 and 52 are arranged upstream of the transporting roller 24 in the transporting direction X so as to guide the sheet ST toward the transporting roller 24. Also, the guide member 51 guides the back surface (the lower surface) of the sheet ST that is transported by the transporting roller 23, while the guide member 52 guides the surface (the upper surface) of the sheet ST that is transported by the transporting roller 23.

Figure 6:
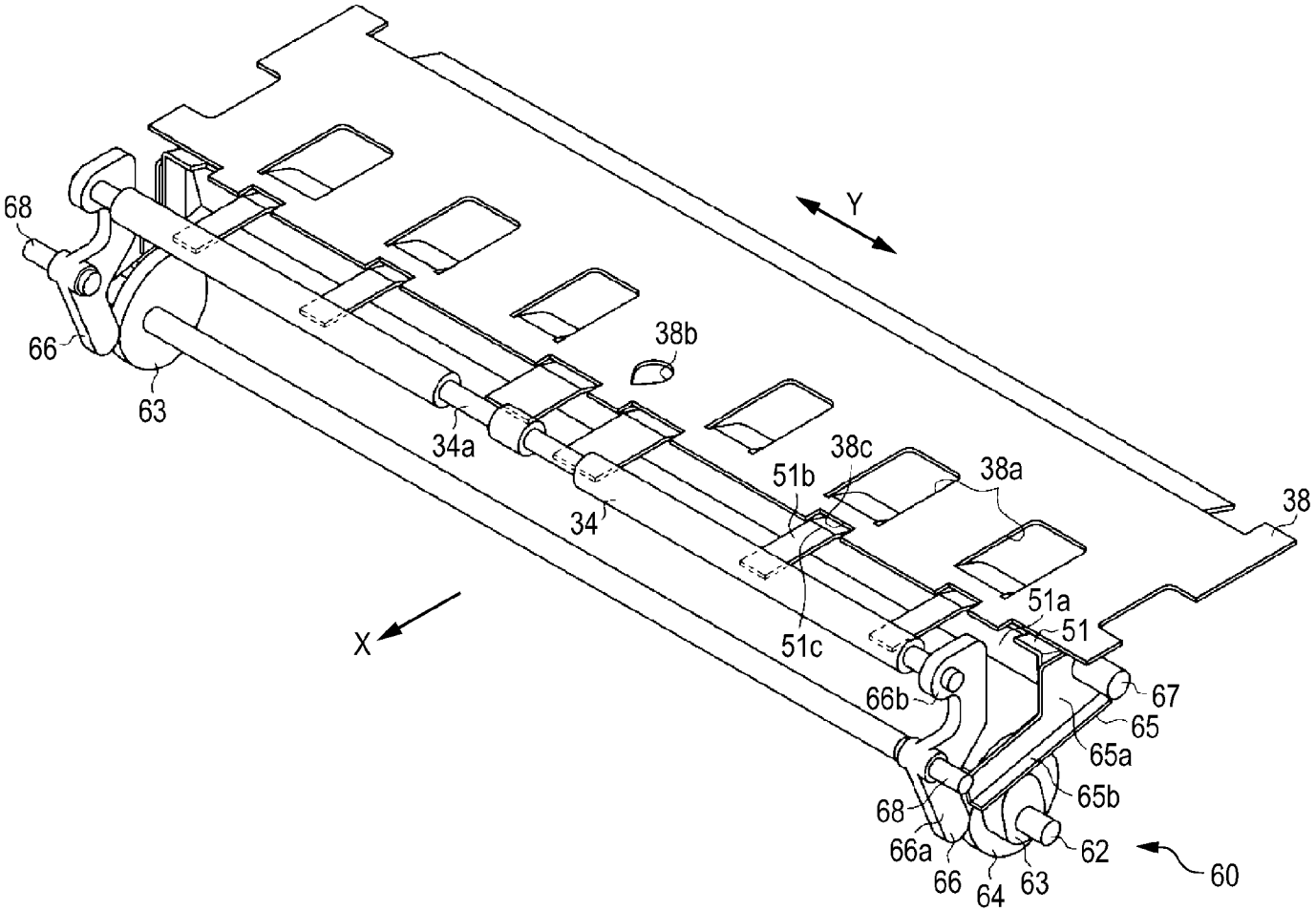
FIG. 6 is a perspective view explaining a cam mechanism and a guide member.

As shown in FIGS. 2 to 6, the guide member 51 has a base end section 51*a* that is provided upstream of the transporting direction X and a comb-shape guide section 51*b* that extends toward downstream from the base end section 51*a* in the transporting direction X. Also, as shown in FIGS. 4 and 5, the guide section 51*b* of the guide member 51 is arranged at a position corresponding to the end of the sheet ST between adjacent transporting rollers 23 in the width direction Y. Also, the transporting passage forming member 38 is arranged upstream of the guide section 51*b* of the guide member 51 in the transporting direction X. Furthermore, as shown in FIG. 6, a bending section 51*c* is formed at the guide section 51*b* of the guide member 51 so as to be bent to separate from the transporting passage forming member 38 as the bending section 51*c* faces the upstream in the transporting direction X.

As shown in FIGS. 4 to 6, downstream of the transporting passage forming member 38 in the transporting direction X, a notch section 38*c* is formed in a position corresponding to the guide section 51*b* of the guide member 51 in the width direction Y so as to permit the displacement of the guide section 51*b*. Also, in FIGS. 4 to 6, the guide member 52 is omitted, and in FIG. 6, the transporting rollers 22, 23 and 24, the driven roller 32 and the cut sheet CS are omitted so as to clearly specify the notch section 38*c* and the guide member 51. Also, in FIGS. 4 and 5, the cut sheet CS is shown by a two-dot chain line.

As shown in FIGS. 2 and 3, the cam mechanism 60 includes a camshaft 62 that is supported at the main case 12, a cam member 63 as a first member that rotates according to the rotation of the camshaft 62, a cam member 64 as a second cam member, and levers 65 and 66 that are driven to the rotation of the cam members 63 and 64 respectively. The lever 65 can rotate about the lever shaft 67 as the center that is arranged upstream of the camshaft 62 in the transporting direction X. Also, the lever 66 can rotate about the lever shaft 68 as the center that is arranged downstream of the camshaft 62 in the transporting direction X. As shown in FIG. 6, the cam members 63 and 64, and the levers 65 and 66 are provided at both ends of the camshaft 62 respectively.

The lever 65 fixes the guide member 51 in the supporting section 65*a* that extends toward the downstream in the transporting direction X from the lever shaft 67. The engaging section 65*b* engages the cam member 63, wherein the engaging section 65*b* extends to the lower side to tilt toward the downstream in the transporting direction X from the supporting section 65*a*. A biasing member (for example, a screw coil spring; not shown) biases the lever 65 in the counterclockwise direction in FIG. 2. At normal times, the lever 65 is retained in a state as shown in FIGS. 2, 4 and 6.

The engaging section 66*a* of the lever 66 that extends in the lower side from the lever shaft 68 engages the cam member 64. The shaft section 34*a* of the driven roller 34 is rotatably supported at the lever 66 in the front end of the supporting section 66*b* that extends to the upper side from the lever shaft 68. Also, the guide member 52 is fixed at the supporting section 66*b* of the lever 66. The lever 65 is biased to the counterclockwise direction in FIG. 2 by the biasing force of the biasing member (for example, the screw coil spring; not shown) and maintains the state shown in FIGS. 2, 4 and 6, at normal times.

The camshaft 62 rotates according to the driving of the cam motor 53. Thus, when the camshaft 62 rotates about 180 degrees from the state of FIG. 2, the cam members 63 and 64 with the camshaft 62 rotate to the position shown in FIG. 3. Thus, the lever 65 rotates in the counterclockwise direction according to the rotation of the cam member 63 in FIG. 2 and the lever 66 rotates in the clockwise direction according to the rotation of the cam member 64 in FIG. 2.

Also, when the camshaft 62 rotates about 180 degrees from the state shown in FIG. 3 according to the driving of the cam motor 53, the cam members 63 and 64 with the camshaft 62 rotate and return to the position shown in FIG. 2. Also, the lever 65 rotates in the clockwise direction according to the rotation of the cam member 63 in FIG. 3 and returns to the position shown in FIG. 2 and the lever 66 rotates in the counterclockwise direction according to the rotation of the cam member 64 in FIG. 3 and returns to the position shown in FIG. 2.

The guide member 51 oscillates about the base end section 51*a* as the center according to the rotation of the lever 65. Accordingly, the guide section 51*b* is displaced between a guide position (a position shown in FIG. 2) that forms the transporting passage and an escaping position (a position shown in FIG. 3) in which the guide section 51*b* separates from the transporting passage. Thus, the guide member 51 constitutes the supporting surface of the sheet ST such that the upper surface of the front end rather than the bending section 51*c* out of the guide section 51*b* is substantially the same surface as that the upper surface of the transporting passage forming member 38 at the guide position. At this time, the bending section 51*c* of the guide member 51 is arranged within the notch section 38*c* of the transporting passage forming member 38.

According to the rotation of the lever 66, the driven roller 34 moves between the standby position (the position shown in FIG. 2) in which the circumferential surface of the driven roller 34 separates from the transporting passage along the moving passage that conforms substantially to the circumferential surface of the transporting roller 24 and the correcting position (the position shown in FIG. 3) where the transporting roller 24 pinches the sheet ST and corrects the curl. Also, at the correcting position, the driven roller 34 is arranged at a position of which the separating distance with the transporting roller 24 is shorter than the thickness of the sheet ST. Also, at the standby position, the driven roller 34 is arranged such that the separating distance with the transporting roller 24 is longer than the thickness of the sheet ST. Accordingly, when the driven roller 34 is in the standby position, the sheet ST is not pinched at the driven roller 34 and is transported to the downstream by the transporting roller 24 along the transporting passage shown as the two-dot chain line in FIG. 3.

As shown in FIG. 2, the length of the guide member 51 is longer than the diameter of the transporting roller 23 in the transporting direction X. The guide section 51*b* extends to a position in which the front end thereof is caught by the transporting roller 24. In other words, the downstream end of the guide section 51*b* of the guide member 51 is arranged at the downstream of the upstream end of the circumferential surface of the transporting roller 24 in the transporting direction X. Also, as shown in FIG. 3, the circumferential surface of the driven roller 34 intersects the transporting passage in which the circumferential surface thereof is shown as the two-dot chain line at the correcting position. Thus, the circumferential surface of the driven roller 34 that is in the correcting position and the guide section 51*b* of the guide member 51 that is in the guide position interfere with each other.

In the embodiment, to avoid the interference between the guide member 51 and the driven roller 34, when the driven roller 34 moves in the lower side toward the correcting position, the guide member 51 can move to the escaping position where the guide member 51 separates from the moving passage that is from the correcting position to the standby position in the lower side of the driven roller 34. Also, if the camshaft 62 rotates, the guide member 51 moves according to the rotation of the cam member 63 and the driven roller 34 moves according to the rotation of the cam member 64. Thus, the guide section 51*b* of the guide member 51 moves from the guide position to the escaping position in the lower side at the timing where the driven roller 34 moves from the standby position to the correcting position in the lower side.

Next, the electrical configuration of the printer 11 will be described.

As shown in FIG. 7, the control device 100 includes a computer 101 as a control member, a head driving circuit 102, and motor driving circuits 103, 104 and 105. The computer 101 is electrically connected to the head driving circuit 102, and the motor driving circuits 103, 104 and 105 through a bus 108.

The computer 101 includes an ASIC (an Application Specific IC) 109, a CPU 110, a ROM 111, a RAM 112 and a non-volatile memory 113. Various control programs and various data are stored in the ROM 111. Various programs including a firmware program and various data required to the printing process are stored in the non-volatile memory 113. As program data that are executed by the CPU 110, various data that are a computing result and a processing result by the CPU 110 and various data that are processed by the ASIC 109 are temporarily stored in the RAM 112.

The computer 101 performs various controls when the CPU 110 executes the programs that are stored in the ROM 111 or the like. For example, the computer 101 controls the recording head 44 through the head driving circuit 102 and controls the rotation motor 19, the transporting motor 37 and the cam motor 53 through the motor driving circuit 103, 104 and 105 respectively. The computer 101 controls the transporting motor 37 based on the detection signal from the rotary encoder 40. Also, the computer 101 controls the cam motor 53 based on the detection result or the like of the sensor 50.

Next, a curl correction process at the printer 11 will be described.

In the printer 11, the curl correction process (the uncurl process) is performed with respect to the cut sheet CS that is cut after the recording process is completed. Also, if the length of the cut sheet CS in the transporting direction X is long, the recording process is performed at the trailing edge of the sheet ST that is arranged at the recording section 15 even though the leading edge of the sheet ST reaches the curl correcting mechanism 17 before cutting.

Thus, at normal times, in a state where the driven roller 34 is arranged at the standby position and the guide member 51 is arranged at the guide position, the correction of the curl is not performed with respect to the sheet ST but the transportation of the sheet ST is performed. Thus, after the cutting of the sheet ST is completed and sequential transportation of the cut sheet CS starts, the driven roller 34 moves from the standby position to the correcting position according to the control of the computer 101 and the curl correction process of the sheet ST starts.

Meanwhile, if the length of the cut sheet CS in the transporting direction X is short, the leading edge of the cut sheet CS does not reach the curl correcting mechanism 17 when the cut sheet CS is cut. Even in this case, in order that the leading edge of the cut sheet CS is reliably inserted between the driven roller 34 and the transporting roller 24, the computer 101 moves the driven roller 34 from the standby position to the correcting position, in a state where the sheet ST is inserted between the transporting roller 24 and the driven roller 34 which are in the standby position.

Figure 8:
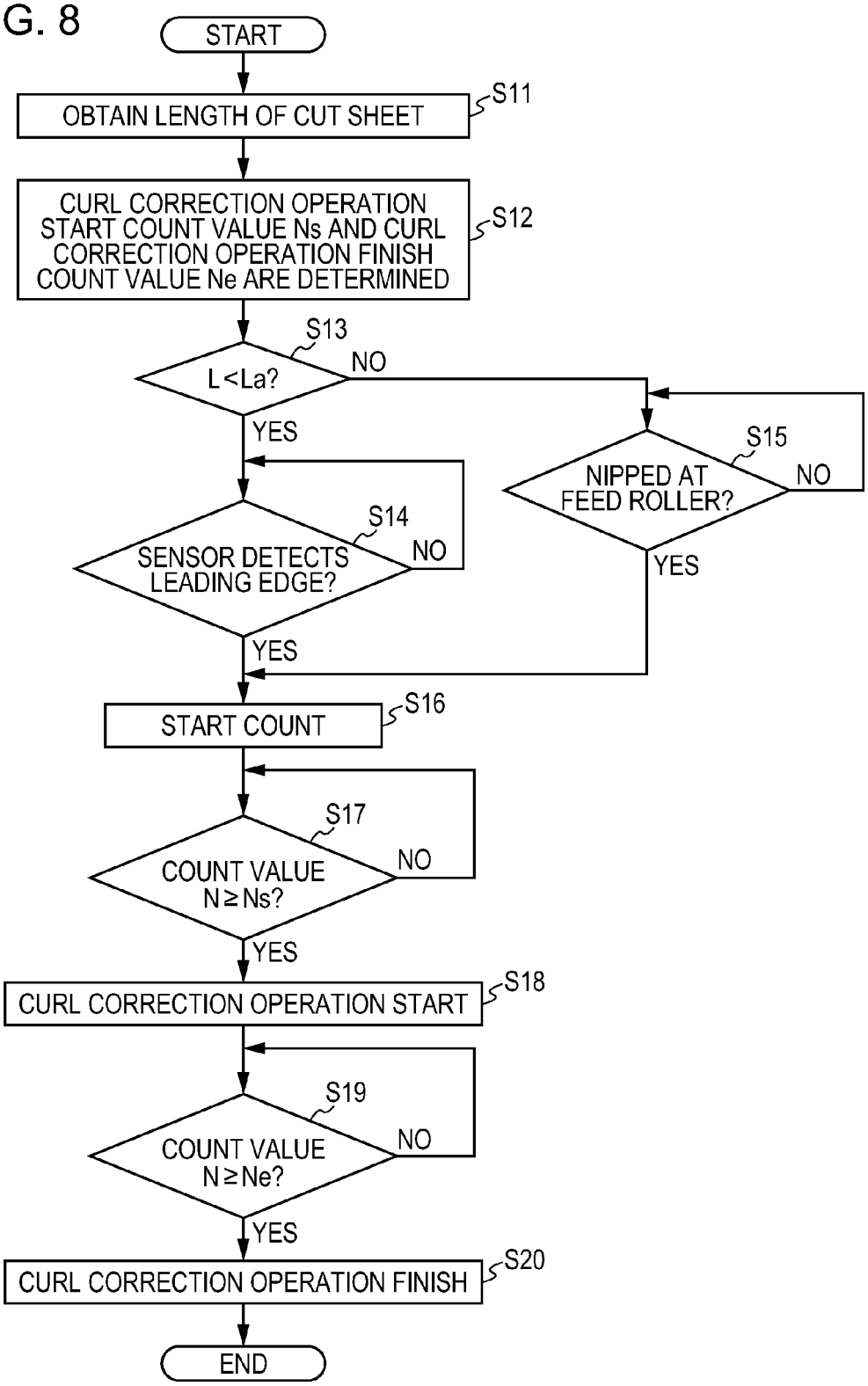
FIG. 8 is a flowchart explaining a curl correction process routine.

Next, a curl correction process routine that is performed by the computer 101 when the cutting of the sheet ST is finished will be described based on FIG. 8.

First of all, in step S11, the computer 101 obtains the length L of the cut sheet CS in the transporting direction X and proceeds to step S12.

In step S12, based on the length L of the cut sheet CS that is obtained by the computer 101, a curl correction operation start count value Ns that determines the timing of the starting of the curl correction operation and a curl correction operation finish count value Ne that determines the timing of the finishing of the curl correction operation are determined, and proceeds to step S13.

In step S13, the computer 101 determines whether the length L of the cut sheet CS is lower than a threshold value La that is predetermined. Thus, the computer 101 proceeds to step S14 if the length L of the cut sheet CS is smaller than the threshold value La or proceeds to step S15 if the length L of the cut sheet CS is larger than or equal to the threshold value La. Also, the threshold value La is predetermined as a value that determines the length of the cut sheet CS and is capable of being stored in the non-volatile memory 113 or the like. For example, when the distance between the position where cutting of the sheet ST is performed and the position where the sensor 50 detects the leading edge of the sheet ST in the transporting direction X is Lb (see FIG. 1), it can be La≤Lb.

In step S14, the computer 101 determines whether the sensor 50 detects the leading edge of the cut sheet CS. The computer 101 proceeds to step S16 if the sensor 50 detects the leading edge of the cut sheet CS while the same determination is repeated at a predetermined timing if the sensor 50 does not detect the leading edge of the cut sheet CS.

In step S15, the computer 101 determines whether the leading edge of the cut sheet CS is nipped (pinched) at a feed roller FR. Thus, the computer 101 proceeds to step S16 if the cut sheet CS is nipped at the feed roller FR while the same determination is repeated at a predetermined timing if the cut sheet CS is not nipped at the feed roller FR.

Also, whether the leading edge of the cut sheet CS is nipped at the feed roller FR is capable of being determined from the length L of the cut sheet CS and the transportation amount of the cut sheet CS after the sheet ST is cut. Meanwhile, if a leading edge detecting sensor is provided downstream of the feed roller FR in the transporting direction X, whether the leading edge of the cut sheet CS is nipped at the feed roller FR is capable of being determined based on the detection result of the leading edge detection sensor.

In step S16, the computer 101 starts the count and proceeds to step S17.

In step S17, the computer 101 determines whether the count value N is larger than or equal to the curl correction operation start count value Ns. Thus, the computer 101 proceeds to step S18 if the count value N is larger than or equal to the curl correction operation start count value Ns while the same determination is repeated at a predetermined timing if the count value N is smaller than the curl correction operation start count value Ns.

In step S18, the computer 101 drives the cam motor 53 so that the curl correction operation starts and proceeds to step S19. Specifically the camshaft 62 rotates about 180 degrees according to the driving of the cam motor 53 so that the driven roller 34 moves from the standby position to the correcting position and the guide member 51 moves from the guide position to the escaping position. Accordingly, the cut sheet CS of which the leading edge inserted between the transporting roller 24 and the driven roller 34 by the guide member 51 is bent in reverse direction to the winding direction of the curl with the transporting roller 23, and the curl is corrected.

In step S19, the computer 101 determines whether the count value N is larger than or equal to the curl correction operation finish count value Ne. The computer 101 proceeds to step S20 if the count value N is larger than or equal to the curl correction operation finish count value Ne while the same determination is repeated at a predetermined timing if the count value N is smaller than the curl correction operation finish count value Ne.

In step S20, the computer 101 drives the cam motor 53 so that the curl correction operation finishes and the process finishes. Specifically the camshaft 62 rotates about 180 degrees according to the driving of the cam motor 53 so that the driven roller 34 moves from the correcting position to the standby position and the guide member 51 moves from the escaping position to the guide position. In other words, the guide member 51 moves toward the guide position where the sheet ST is guided from the escaping position to the transporting roller 24 along the transporting passage according to the movement of the driven roller 34 from the correction position to the standby position.

Also, the cut sheet CS where the curl is corrected is reversed during transportation along the reverse passage-forming member 39. In a state where the surface in which the printing is performed is directed to the lower side, the cut sheet CS discharges to the paper discharging section 12*a*. When the cut sheet CS is pinched, the driven roller 34 moves from the standby position that is separated to the upper side from the transporting roller 24 to the correcting position that is the upstream of the standby position in the transporting direction X. Thus, the transporting roller 24 transports the uncurled sheet ST so that the leading edge of the sheet ST, which becomes the downstream in the transporting direction X, tilts toward the upper side and the sheet ST is entered to the reverse passage smoothly.

According to the embodiment, the effect is capable of being obtained as below.

(1) Even though the leading edge of the sheet ST is curled, the sheet ST is guided by the guide member 51 having the guide section 51*b* that is extended in the transporting direction X along the transporting passage so that the curled leading edge is transported to the transporting roller 24 without separating from the transporting passage. Thus, when the driven roller 34 moves to the correcting position, the guide member 51 can move to the escaping position where the guide member 51 separates from the moving passage that is from the correcting position to the standby position of the driven roller 34. Thus, even though the driven roller 34 moves, the interference with the driven roller 34 is capable of being avoided. Accordingly, the generation of the transportation failure is capable of being suppressed when the sheet ST is transported before the curl is corrected.

(2) When the driven roller 34 moves from the correcting position to the standby position, the guide member 51 moves from the escaping position to the guide position and the sheet ST is capable of being reliably guided to the transporting roller 24 in the guide position.

(3) The sheet ST is capable of being reliably transported toward the transporting roller 24 by the transporting roller 23. Also, the length of the guide member 51 in the transporting direction X is longer than the diameter of the transporting roller 23 so that the guide member 51 is capable of suppressing that the curled leading edge of the sheet ST is drawn or wound to the transporting roller 23. Thus, the downstream end of the guide member 51 in the transporting direction X is arranged at the downstream of the upstream end of the circumferential surface of the transporting roller 24 so that the sheet ST is capable of being reliably guided to the circumferential surface of the transporting roller 24 even in a case where the leading edge of the sheet ST is curled.

(4) The guide section 51*b* of the guide member 51 is arranged between the transporting rollers 23 that are adjacent in the width direction Y. Accordingly, the guide section 51*b* is arranged at the position corresponding to the end section of the sheet ST in the width direction Y so that the end section of the sheet ST is capable of being reliably guided.

(5) The guide member 51 oscillates about the base end section 51*a* as the center, which is provided upstream in the transporting direction X so that the guide section 51*b* is capable of being displaced without disturbing the transportation of the sheet ST. Thus, the guide section 51*b* forms the comb-shape transporting passage at the guide position so that a sliding contact with the sheet ST is capable of being suppressed while the sheet ST is capable of being guided. Also, the notch section 38*c* is provided at the transporting passage forming member 38 so that the gap between the transporting passage forming member 38 and the guide section 51*b* is capable of being small, and the sheet ST is capable of suppressing the drawing in the gap.

(6) The bending section 51*c* is formed at the guide section 51*b* of the guide member 51 so that the leading edge of the sheet ST is capable of being guided to the front end of the guide section 51*b* by the bending section 51*c* even in a case where the leading edge of the sheet ST that is transported from the upstream is curled.

(7) The movement of the cam member 64 is in line with the movement of the cam member 63 so that the guide member 51 is capable of being moved to the escaping position at a timing in which the driven roller 34 moves from the standby position to the correcting position.

(8) The transporting roller 23 is arranged upstream of the transporting roller 24 in the transporting direction X. Thus, even if the leading edge of the sheet ST is curled, the transporting roller 23 rotates so that the drawing of the sheet ST is suppressed and the leading edge of the sheet ST is capable of being reliably transported toward the transporting roller 24. Accordingly, when the sheet ST is transported so as to process the curl correction, the generation of the transportation failure that is caused by the curl of the sheet ST is capable of being further suppressed compared to a case where the driven roller is arranged upstream of the transporting roller 24.

(9) When the sheet ST is pinched between the transporting roller 24 and the driven roller 34 at the correcting position, the driven roller 34 is capable of correcting the curl of the sheet ST. Also, the driven roller 34 moves from the correcting position to the standby position so that the sheet ST is capable of being passed without bending. Accordingly, when the curl correction is not required, the driven roller 34 moves to the standby position so that the load is capable of being decreased when the sheet ST is transported.

(10) When the driven roller 34 moves to the correcting position, the sheet ST is transported by the transporting roller 24 so that the leading edge that becomes the downstream in the transporting direction X is tilted toward the upper side. Accordingly, the sheet ST is capable of being entered smoothly to the reverse passage. Also, if the driven roller 34 is a driving roller, the leading edge of the sheet ST that is directed to the upper side is wound according to the rotation of the driving roller. However, the driven roller 34 is a driven roller so that the sheet ST is capable of suppressing the winding at the driven roller 34.

(11) By moving the driven roller 34 to the standby position, the sheet ST is capable of being smoothly inserted between the driven roller 34 and the transporting roller 24. Thus, in a state where the sheet ST is inserted between the driven roller 34 and the transporting roller 24, the driven roller 34 moves from the standby position to the correcting position so that the sheet ST is capable of being reliably pinched.

The above-described embodiments may be changed as described below.

For example, the driven roller 34 may be constituted to move to a plurality of correcting positions or standby positions according to the thickness of the sheet ST.

The number provided and the size in the width direction Y of the transporting rollers 22, 23 and 24, and the driven rollers 32 and 34 may be changed arbitrarily.

The sensor 50 is not limited to the optical sensor and may be changed to an arbitrary type of sensor such as a contact type sensor or the like.

The feed roller FR may be provided at a position that is somewhere on the reversing passage forming member 39.

Figure 9:
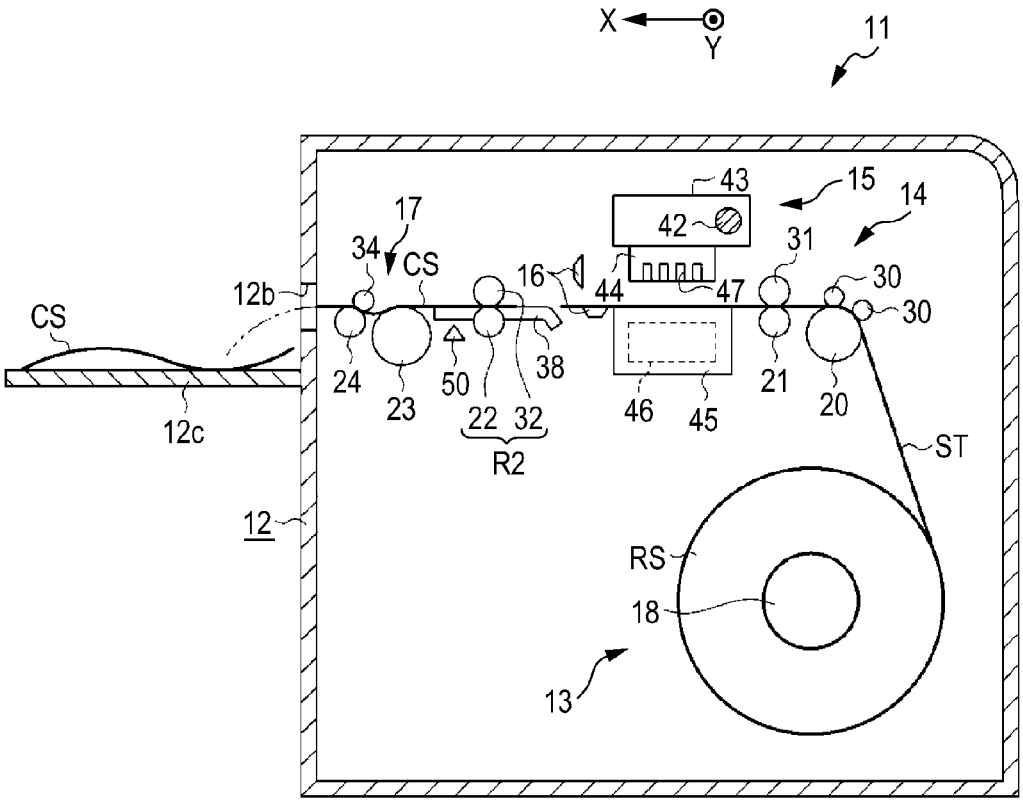
FIG. 9 is a cross-sectional view illustrating a modified example of a paper discharging section.

For example, as shown in FIG. 9, the cut sheet CS is not reversed and the cut sheet CS may be discharged to the paper discharging section 12*c* that is provided at the outside of the main case 12 through the opening section 12*b* that is provided at the main case 12 without providing the feed roller FR or the reversing passage forming member 39. Also, in this case, during the process in which the cut sheet CS is discharged from the opening section 12*b*, the leading edge thereof may be curled by the self-weight as shown in the two-dot chain line in FIG. 9. Thus, when only the leading edge of the cut sheet CS where the curl has been corrected is curled, the cut sheet CS becomes a shape having poor balance so that, in this case, only the trailing edge of the cut sheet CS may perform the curl correction process. Accordingly, the cut sheet CS may become a shape having good balance in which the leading edge and the trailing edge thereof are curled in reverse respectively such as the cut sheet CS shown on the paper discharging section 12*c* in FIG. 9.

In the above-described embodiments, the sheet ST is transported in a state where the leading edge thereof is curled so as to separate from the transporting passage in the lower side; however, the sheet ST may be transported in a state where the leading edge of the sheet ST is curled in a direction (for example, the upper side or a lateral side) other than the lower side. Thus, in this case, the transporting rollers 23 and 24, and the guide member 51 may be arranged at the side where the leading edge of the sheet ST is pinched and curled in the transporting passage, while the driven roller 34 may be arranged at the position corresponding to the transporting roller 24.

The sheet ST is not limited to the paper and may be applied to arbitrary sheet shape media such as a resin film, a metal film or the like having the tendency to be wound since the media are maintained in a state of winding and overlapping in a roll shape.

The recording process is not limited to performing the printing or typing and may be various processes, for example, attaching a seal to the sheet-shaped medium, transferring a foil to the sheet-shaped medium, piercing a hole in the sheet-shaped medium and forming a notch in the sheet-shaped medium. Thus, the transporting apparatus of the invention may be included to the process apparatus that performs each of these processes, the curl may be corrected before these processes are performed and the curl may be corrected after these processes are performed.

In the above-described embodiments, description has been given regarding the recording apparatus that employs the ink jet type as the recording type; however, the recording apparatus may be changed to a recording apparatus having an arbitrary recording type such as an electronic transferring type, thermal transferring type or the like. Also, the recording apparatus is not limited to the printer and may be a facsimile apparatus, a copying apparatus or a multifunction peripheral that includes a plurality of functions or the like. Furthermore, as the recording apparatus, an apparatus may employ a liquid ejection apparatus that includes a liquid ejecting head or the like that ejects or discharges liquid droplets with a micro quantity of fluid other than ink. Also, the term liquid droplets refers to a state of liquid that is ejected from the liquid ejection apparatus and also includes droplets that draw a trailing edge in a granule shape, a dripping shape and a string shape. Also, liquid described in here may be any material that can be ejected from the liquid ejection apparatus. For example, the material may be in a state of a liquid phase. The material includes not only a liquid material having a high viscosity or a low viscosity, a flow phase material such as sol, gel water, other inorganic solvent, organic solvent, solution, liquid phase resin, liquid phase metal (metal fusing liquid). Additionally, the material includes not only liquid as a material state but also a material in which particles of a functional material that is formed from a solid material, such as a pigment, metal particles or the like, are dissolved, dispersed or mixed in the solvent. Representative examples of the liquid are ink, liquid crystal and the like that are described in the embodiments. Here, ink includes general water ink, oil ink, and other ink such as gel ink, hot melt ink or the like, which include various liquid compositions. As a specific example of the liquid ejection apparatus, there are, for example, a liquid crystal display, an EL (electro-luminescence) display, a surface emitting display, a liquid ejection apparatus that ejects liquid including materials for an electrode material, color material or the like as a dispersing or dissolved phase that is used to manufacture a color filter and a printing apparatus.

What is claimed is:

1. A transportation device comprising:

a first roller that transports a sheet-shaped medium from an upstream side to a downstream side in a transporting direction along a transporting passage;

a guide member that has a base end and a guide section extended along the transporting direction, wherein the guide member is arranged upstream of the first roller in the transporting direction, the base end being upstream of the guide section and the first roller in the transporting direction and the guide section oscillates about the base end; and a second roller that is paired with the first roller and wherein the second roller is movable between a correcting position where the second roller pinches the sheet-shaped medium with the first roller and corrects a curl of the sheet-shaped medium, and a standby position where the second roller separates from the transporting passage, a rotational axis about which the guide section oscillates and a rotational axis about which the second roller pivots from the correcting position to the standby position are positioned on opposite sides of a rotational axis of the first roller in the transporting direction, with both the rotational axis for the guide section and the rotational axis for the second roller being below the transporting passage and the rotational axis of the first roller, wherein movement of the guide member is synchronized with movement of the second roller between the correcting position and the standby position such that the guide member moves to an escaping position where the guide member is separated from the transporting passage when the second roller moves to the correcting position and wherein the guide member includes a flat surface that is configured to support and guide a surface of the sheet-shaped medium in the transporting passage in a guide position where the guide member is not separated from the transporting passage when the second roller is in the standby position.

2. The transportation device according to claim 1, wherein the guide member moves toward the guide position where the guide member guides the sheet-shaped medium to the first roller along the transporting passage when the second roller moves to the standby position.

3. The transportation device according to claim 1, further comprising:

a cam mechanism that has a camshaft, a first cam member and a second cam member which rotate according to the rotation of the camshaft, wherein the guide member moves according to the rotation of the first cam member and the second roller moves according to the rotation of the second cam member.

4. A recording apparatus comprising:

a retaining section that retains a sheet-shaped medium in a state of a roll body that winds and overlaps the sheet-shaped medium in a roll shape;

a recording unit that performs the recording with respect to the sheet-shaped medium that is unwound from the roll body; and a transportation device according to claim 1.

5. The transportation device according to claim 1, further comprising:

a transporting roller that transports the sheet-shaped medium from upstream in the transporting direction toward the first roller, wherein the guide member is longer than a diameter of the transporting roller in the transporting direction and the downstream end thereof is arranged downstream of an upstream end of a circumferential surface of the first roller in the transporting direction.

6. The transportation device according to claim 5, wherein the transporting roller includes a plurality of rollers that are arranged in the width direction, wherein the plurality of rollers are separated by gaps in the width direction of the sheet-shaped medium that crosses the transporting direction, and wherein the guide section of the guide member is arranged between each of the plurality of rollers, wherein the plurality of rollers are positioned adjacent to each other in the width direction.

7. The transportation device according to claim 1, further comprising:

a transporting passage forming member that is arranged upstream of the guide section of the guide member in the transporting direction, wherein the guide member has a comb-shape guide section that extends toward downstream side in the transporting direction from the base end, and the guide member is displaced between the guide position where the guide member forms the transporting passage and the escaping position where the guide section separates from the transporting passage, wherein the guide member oscillates about a lever shaft of the base end when moving to or from the guide position, and wherein a notch that permits a displacement of the guide section is formed at a position corresponding to the guide section in the width direction of the sheet-shaped medium that crosses the transporting direction at a downstream end of the transporting passage forming member in the transporting direction.

8. The transportation device according to claim 7, wherein a bending member is formed at the guide section of the guide member and the bending member is bent so as to separate from the transporting passage forming member as the guide section faces upstream in the transporting direction.

* * * * *